US005092289A

United States Patent [19]

Bloschies et al.

[11] Patent Number: 5,092,289

[45] Date of Patent: Mar. 3, 1992

[54] LIGHT ALLOY PISTON

[75] Inventors: Gerhard Bloschies, Bad Friedrichshall; Siegfried Mielke, Neckarsulm, both of Fed. Rep. of Germany

[73] Assignee: Kolbenschmidt Aktiengesellschaft, Neckarsulm, Fed. Rep. of Germany

[21] Appl. No.: 701,541

[22] Filed: May 15, 1991

[30] Foreign Application Priority Data

Jun. 22, 1990 [DE] Fed. Rep. of Germany ..... 4019983

[51] Int. Cl.[5] ..... F02F 3/00

[52] U.S. Cl. ..... 123/193.6; 92/212; 92/213; 92/223; 92/224

[58] Field of Search ..... 123/193 P, 193 CP; 92/212, 213, 222, 223, 224

[56] References Cited

U.S. PATENT DOCUMENTS

| | | | |
|---|---|---|---|
| 4,195,597 | 4/1980 | Hofbauer et al. | 123/193 P |
| 4,679,493 | 7/1987 | Munro et al. | 92/213 |
| 4,838,149 | 6/1989 | Donnison et al. | 123/193 P |
| 4,920,864 | 5/1990 | Skingle et al. | 92/212 |

*Primary Examiner*—E. Rollins Cross
*Assistant Examiner*—M. Macy
*Attorney, Agent, or Firm*—Sprung Horn Kramer & Woods

[57] ABSTRACT

In a light alloy piston for use in diesel engines for an indirect fuel injection, a body of fibrous material is embedded in the cast piston head and is formed with a shallow combustion recess. In order to improve the conduction of heat outside the portion formed with the combustion recess, the body of fibrous material has a larger height on the side that is formed with the combustion recess than in the remaining portion of the piston head.

5 Claims, 1 Drawing Sheet

LIGHT ALLOY PISTON

DESCRIPTION

Figure 1:
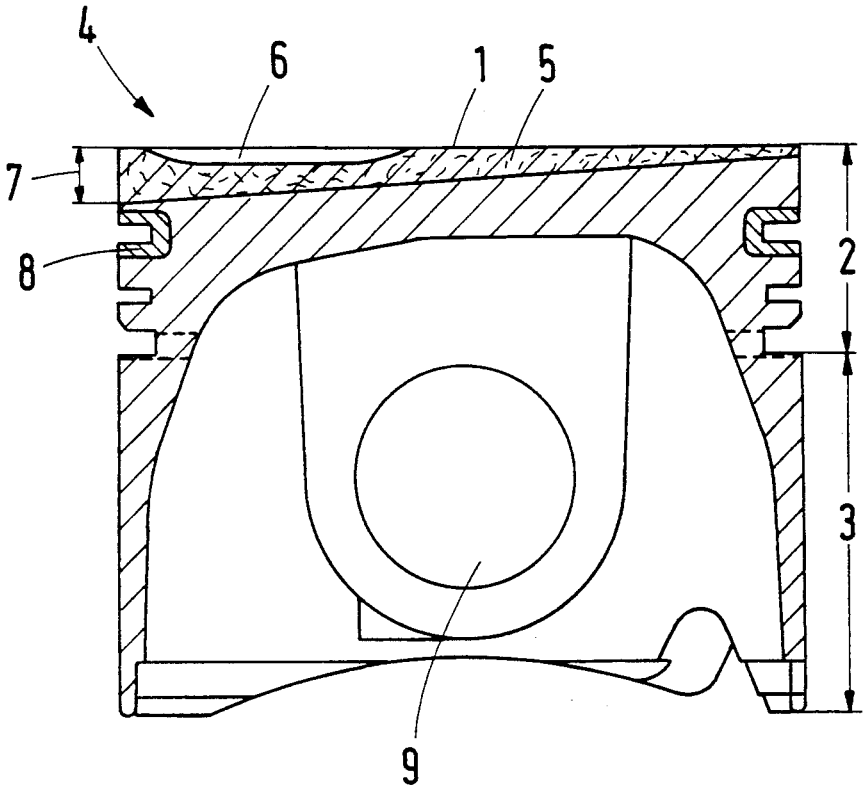

This invention relates to a pressure-diecast light alloy piston, which is made of an aluminum alloy that is suitable for use in pistons and which is intended for use in diesel engines for an indirect fuel injection, which piston comprises a cylindrical body of fibrous material that is embedded in the cast piston head and formed with a shallow and preferably finger-shaped or eyeglass-shaped combustion recess, which is arranged to receive the flame jets which are projected from the combustion chamber that is formed in the cylinder head.

In diesel engines which comprise light alloy pistons and are designed for an indirect fuel injection the combustion space is divided into a combustion chamber in the cylinder head and a shallow combustion recess formed in the piston head. The combustion recess is arranged to receive the flame jets which are projected from the combustion chamber and is preferably finger-shaped or eyeglass-shaped. Particularly during an operation of the engine under strongly changing loads a superposition of thermal and mechanical alternating stresses will cause cracks to be formed, in most cases at the bottom of the combustion recess, and after a relatively long time of operation such cracks may extend throughout the cross-section of the piston head. As regards the selection of materials resisting the influences of the surface temperature, which fluctuates in step with the combustion cycles, it has been found satisfactory to provide the piston head with a hard-anodized layer. The oxide layer formed by anodizing has a thickness between 30 and 100 $\mu$m and will increase the life of the piston head, particularly when it is subjected to alternating thermal stresses, by a factor of 3 to 5. For use in diesel engines for an operation under particularly high loads it is known to protect the piston head by the provision of the baffle plate, which consists of heat-resisting steel and is screwed in the piston head (Mahle-Kolbenkunde, No. 2, Stuttgart 1985, page 16). Another measure by which the load-carrying capacity of the light alloy piston can be increased is the use of the pressure diecasting process, in which the molten light alloy is charged into the casting mold under an adjustable pressure and is subsequently caused to solidify under a high pressure of up to or more than 1000 bars. That casting process is being used, for instance, to manufacture light alloy pistons which are intended for use in diesel engines and comprise a body that consists of fibrous material and is embedded in the cast piston head and formed with the combustion recess. Under the final pressure of more than 1000 bars which is applied, the molten material and the fibrous material approach each other to an atomic spacing so that the fibers and the matrix will interreact in the controlled manner which is required for a strong bond. The reinforcing fibers are usually of alumina fibers, aluminum silicate fibers or silicon carbide whiskers and the content of fibers and/or whiskers in said body may amount to up to 30% by volume. Owing to the low thermal conductivity and the small expansion of the light alloy material of the piston head that is protected from the hot flame jets by the body of fibrous material, said piston head has an excellent resistance to cylic temperature stresses. First incipient cracks will not occur until the material has experienced about 7000 temperature cycles and the incipient cracks will exhibit only a relatively slight growth as the testing time increases (KS jubilee publication: 75 Jahre Kolbenschmidt AG, Neckarsulm, September 1985, page 14). The thermal conductivity of the light alloy piston is reduced by more than $\frac{1}{3}$ by the use of a body of fibrous material.

The low thermal conductivity has both desirable and undesirable influences on the load-carrying capacity of the light alloy piston. The fibrous reinforcement in the piston head will reduce the thermal load-carrying capacity of the light alloy material. On the other hand, the temperature of the remaining portions of the piston should not excessively be decreased so that a higher thermal conductivity is desired in that portion of the piston head which is not contacted by the flame jets which are projected from the combustion chamber of the cylinder head.

The object which is apparent therefrom is accomplished in accordance with the invention in that the height of the body of fibrous material is larger on that side which is formed with the combustion recess than in the remaining portion of the piston head.

In accordance with the invention the body of fibrous material has an oblique surface on the side which faces the interior of the piston. For that purpose a further feature of the invention resides in that the body of fibrous material has the shape of a cylinder which has an oblique end face at one end or the shape of a cylindrical hoof.

According to a further feature of the invention the body of fibrous material has at its periphery a height of 5 to 15 mm on one side and a height of 2 to 8 mm on the opposite side.

The fibers of the body extend parallel to the plane which contains the axis of the piston and the axis of the piston pin and have a random orientation within that plane.

By the provision of the body of fibrous material which is embedded in the cast piston head and has the design according to the invention it is ensured that the temperature rise occurring in the piston material under the body of fibrous material adjacent to the combustion recess will be kept within limits but the temperature of the remaining portions of the piston can be kept at the desired level. Because bodies of fibrous material consisting of alumina fibers, aluminum silicate fibers or silicon carbide whiskers are rather expensive, the use of a body which is made of fibrous material and designed in accordance with the invention permits the costs of such body to be decreased by as much as 30.

This invention is illustrated by way of example in the drawing and will be explained in more detail hereinafter.

Figure 2:
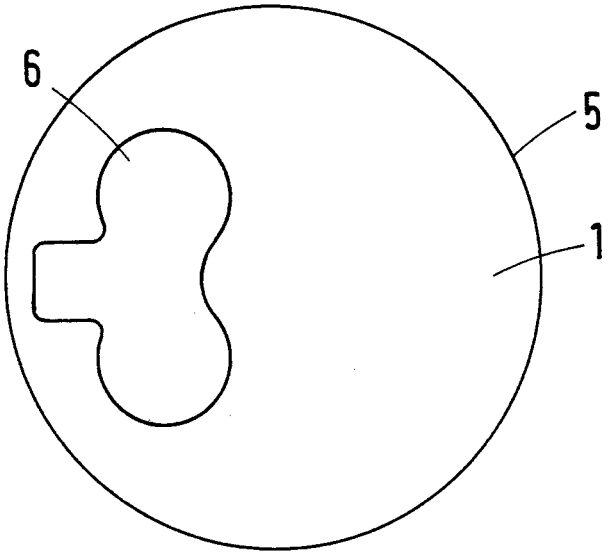

FIG. 1 is a longitudinal sectional view showing a light alloy piston which is intended for use in diesel engines for an indirect fuel injection, the view being taken on a plane which includes the axis of the piston and the axis which is at right angles to the piston pin axis; and FIG. 2 is a top plan view showing the piston head of a light alloy piston for use in diesel engines for an indirect fuel injection.

Referring now more particularly to the drawing, a piston 4 for use in diesel engines for an indirect fuel injection is made in one piece by pressure diecasting from an aluminum alloy of the type AlSi12CuNiMg and comprises a piston head 1, a ring-carrying portion 2 and a piston skirt 3. A body 5 of fibrous material is embedded in the piston head 1 and has the shape of a circular cylinder which has been cut off in an oblique direction and is equal in diameter to the piston 4. The body 5 consist of $Al_2O_3$ fibers amounting to 25% by volume of the body 5. The body 5 of fibrous material is formed with an eyeglass-shaped combustion recess 6, which is arranged to receive the flame jets which are projected from the combustion chamber that is formed in the cylinder head. In the plane which contains the axis of the piston and the axis which is at right angles to the axis of the piston pin the body 5 of fibrous material has at its periphery a height 7 of 7 mm on one side and a height 7 of 2.5 mm on the opposite side. A ring carrier 8 consisting of austenitic special cast iron is embedded in and metallically bonded to the piston casting adjacent to the first ring groove. The bores 9 for the piston pin are formed in the piston skirt 3, which constitutes a continuous surface of revolution.

It will be understood that the specification and examples are illustrative but not limitative of the present invention and that other embodiments within the spirit and scope of the invention will suggest themselves to those skilled in the art.

What is claimed is:

1. In a pressure-diecast light alloy piston, which is made of an aluminum alloy that is suitable for use in pistons and which is intended for use in diesel engines for an indirect fuel injection, which piston comprises a cylindrical body of fibrous material that is embedded in the cast piston head and formed with a shallow and finger-shaped or eyeglass-shaped combustion recess, which is arranged to receive the flame jets which are projected from the combustion chamber that is formed in the cylinder head, the improvement wherein the height (7) of the body (5) of fibrous material is larger on the side which is formed with the combustion recess (6) than in the remaining portion of the piston head (1).

2. A light alloy piston according to claim 1, wherein the body (5) of fibrous material has an oblique surface on the side which faces the interior of the piston.

3. A light alloy piston according to claim 1, wherein the body (5) of fibrous material has the shape of a cylinder which has obliquely been cut off at one end.

4. A light alloy piston according to claim 1, wherein the body (5) of fibrous material has the shape of a cylindrical hoof.

5. A light alloy piston according to claim 1, wherein in the plane which contains the axis of the piston and the axis which is at right angles to the axis of the piston pin the body (5) of fibrous material has at its periphery a height (7) of 5 to 15 mm on one side and a height (7) of 2 to 8 mm on the opposite side.

* * * * *